US009282789B1

(12) United States Patent
Lavoie

(10) Patent No.: US 9,282,789 B1
(45) Date of Patent: Mar. 15, 2016

(54) CUFFLINK

(71) Applicant: Roland G. Lavoie, Sudbury (CA)

(72) Inventor: Roland G. Lavoie, Sudbury (CA)

( * ) Notice: Subject to any disclaimer, the term of this patent is extended or adjusted under 35 U.S.C. 154(b) by 0 days.

(21) Appl. No.: 14/698,458

(22) Filed: Apr. 28, 2015

(51) Int. Cl.
*A44B 5/02* (2006.01)
*A44B 5/00* (2006.01)

(52) U.S. Cl.
CPC ..... *A44B 5/002* (2013.01)

(58) Field of Classification Search
CPC ..... A44B 5/00; A44B 5/002; A44B 5/005
USPC ..... 24/102 PL, 102 R, 102 A, 90.5, 114.11, 24/114.2; 2/123
See application file for complete search history.

(56) References Cited

U.S. PATENT DOCUMENTS 1,384,526 A * 7/1921 Keeton ..... A44B 5/02 24/299
1,562,724 A * 11/1925 Redfield ..... A44B 5/00 24/102 R
1,598,576 A * 8/1926 Habenicht ..... A44B 5/00 24/102 FC
1,675,379 A * 7/1928 Pejchar ..... A44B 5/00 24/90.5
2,920,363 A * 1/1960 Avedon ..... A44B 5/002 24/97
3,093,220 A * 6/1963 Modrey ..... F16B 2/185 114/227
3,418,699 A 12/1968 Feldman
3,634,911 A 1/1972 Mobell
3,829,936 A * 8/1974 Schuchman ..... A44B 5/00 24/41.1
3,832,736 A * 9/1974 Schuchman, Jr. ..... A44B 5/002 2/123
4,242,776 A * 1/1981 Kurashima ..... A44B 5/02 24/102 SL

FOREIGN PATENT DOCUMENTS

JP 3103472 6/2004

* cited by examiner

*Primary Examiner* — Robert J Sandy
*Assistant Examiner* — Rowland Do
(74) *Attorney, Agent, or Firm* — Lynn C. Schumacher; Hill & Schumacher

(57) ABSTRACT

A cufflink with a decorative head, an elongate post attached at one end to the head and an elongate toggle member pivotally attached to the opposite end of the elongate post, and a compressible spacer member. The cufflink solves the problem of inadvertent opening (the toggle member being pivoted into colinear alignment with the elongate post) by having the deformable spacer member which prevents the toggle pivotally attached on the elongate post from opening prematurely. The compressible spacer produces resistance to prevent the toggle, when rotated 90 degrees to the elongate post, from opening and it is sized and shaped to eliminate any space between the toggle, in the closed position at 90 degrees and the shirt making it almost impossible to have the toggle open without manually forcing the toggle to open.

4 Claims, 3 Drawing Sheets

CUFFLINK

FIELD

The present disclosure relates to a cufflink, and more particularly the present disclosure relates to a cufflink with a friction component for reducing inadvertent or accidental opening of the cufflink to prevent loss of the cufflink.

BACKGROUND

A problem with cufflinks is that when being worn the toggle member can open inadvertently to the position used to insert, and remove it, from a shirt cuff, causing the cufflink to fall and be lost. The toggle can inadvertently be moved to this position due to friction between it and a coat jacket being worn or rubbing up against counter tops or tables.

Thus it would be advantageous to provide a cufflink in which premature movement of the toggle member is prevented.

SUMMARY

The present disclosure provides a cufflink. The cufflink includes a) a decorative head member having an outward facing decorative surface and a back surface;

b) an elongate post member having a proximal end permanently affixed to said back surface of said decorative head member, an elongate toggle member pivotally attached to a distal end of said elongate post member and moveable between an open position wherein said elongate toggle member is colinear with said elongate post member, for insertion through one side of a cuff of a shirt, and a closed position wherein said elongate toggle member is rotated perpendicular to said elongate post member, on an opposite side of the cuff of the shirt with said elongate post member and a portion of said elongate post member inserted through the cuffs of the shirt;

c) a rigid cap member having an aperture centrally disposed in said cap member for receiving therethrough said toggle member and said distal end of said elongate post member; and d) a compressible spacer member having a generally centrally located aperture for receiving therethrough said toggle member and said distal end of said elongate post member on the opposite side of the cuff of the shirt, said compressible spacer member being made of a rubber based material, said compressible spacer member having a size and shape to be received into said cap member, said rigid cap member and said compressible spacer member having a combined thickness such that when assembled on the shirt sleeve with said elongate toggle member in the closed position it abuts an outer face of said rigid cap member to reduce inadvertent pivoting of the elongate toggle member into colinear alignment with said elongate post member.

The cufflink disclosed herein solves the above noted problem by having the compressible spacer member which prevents the toggle pivotally attached on the elongate post from opening prematurely. The spacer member produces resistance to prevent the toggle, when rotated 90 degrees to the elongate post, from opening and it is sized and shaped to eliminate any space between the toggle, in the closed position at 90 degrees) and the shirt making it almost impossible to have the toggle open without manually forcing the toggle to open.

A further understanding of the functional and advantageous aspects of the present disclosure can be realized by reference to the following detailed description and drawings.

BRIEF DESCRIPTION OF THE DRAWINGS

Embodiments will now be described, by way of example only, with reference to the drawings, in which.

DETAILED DESCRIPTION

Various embodiments and aspects of the disclosure will be described with reference to details discussed below. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the terms "about" and "approximately" are meant to cover variations that may exist in the upper and lower limits of the ranges of values, such as variations in properties, parameters, and dimensions. In one non-limiting example, the terms "about" and "approximately" mean plus or minus 10 percent or less.

Unless defined otherwise, all technical and scientific terms used herein are intended to have the same meaning as commonly understood to one of ordinary skill in the art.

Figure 1:
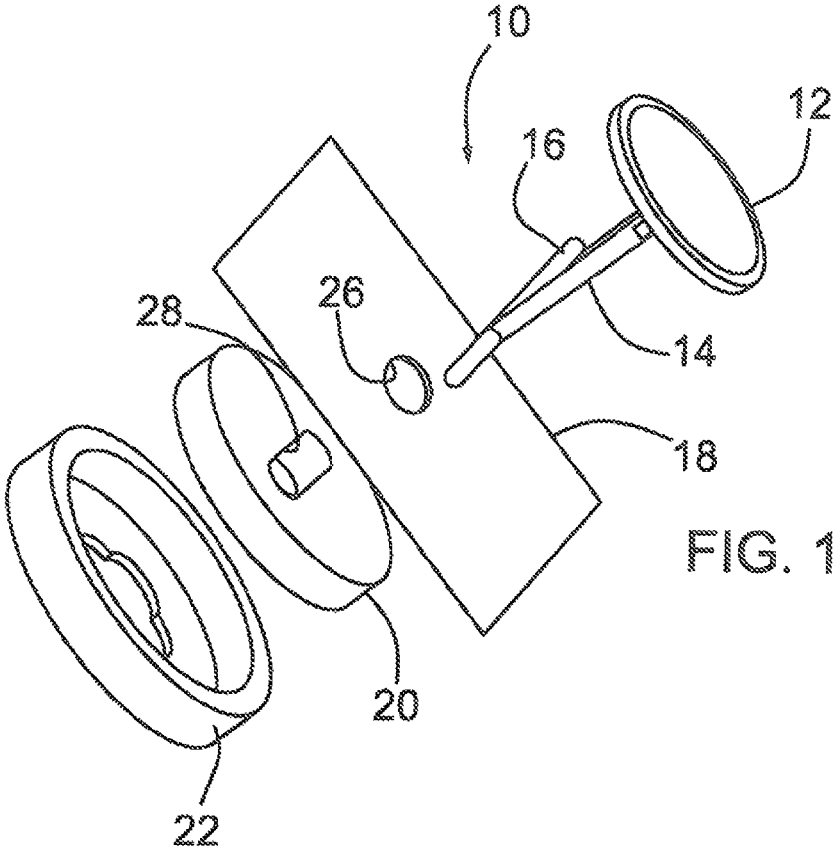
FIG. 1 shows a perspective view of a cufflink according to the present disclosure disassembled.
Figure 2:
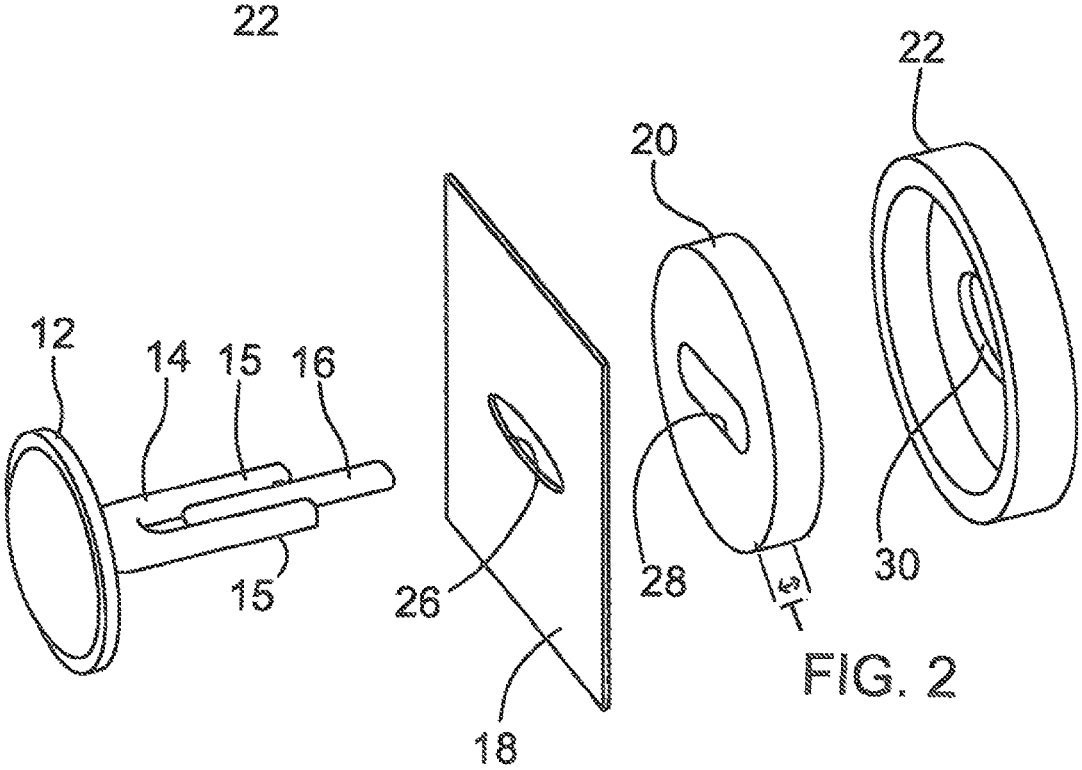
FIG. 2 shows a perspective view of the cufflink of FIG. 1 taken from a different direction than the view of FIG. 1.
Figure 3:
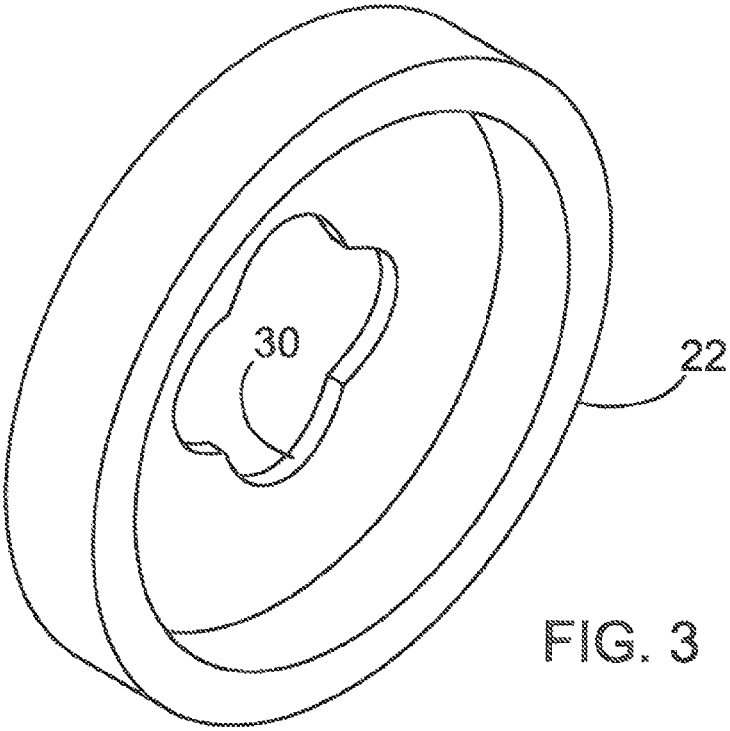
FIG. 3 is a perspective view of a component of the cufflink of FIG. 1 viewing from the front of the component.
Figure 4:
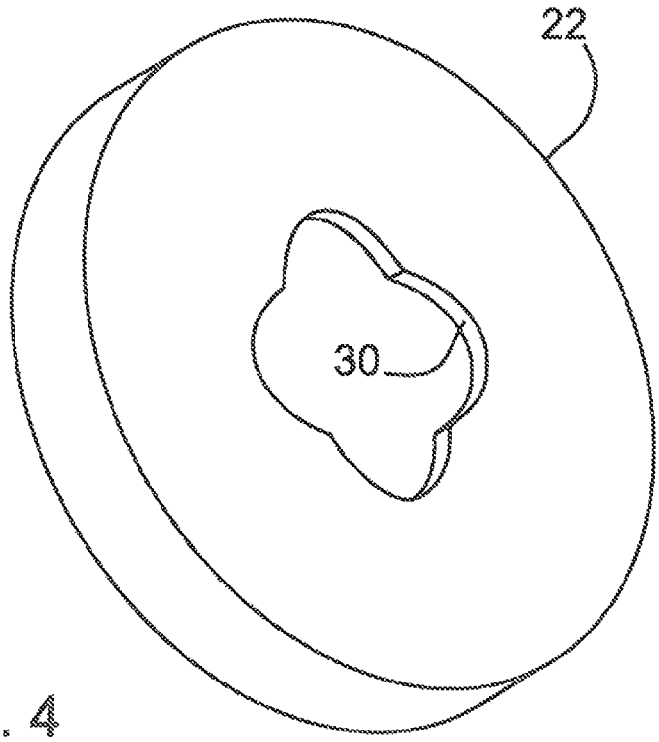
FIG. 4 is another perspective view of the component of FIG. 3 viewing from the back of the component.
Figure 5:
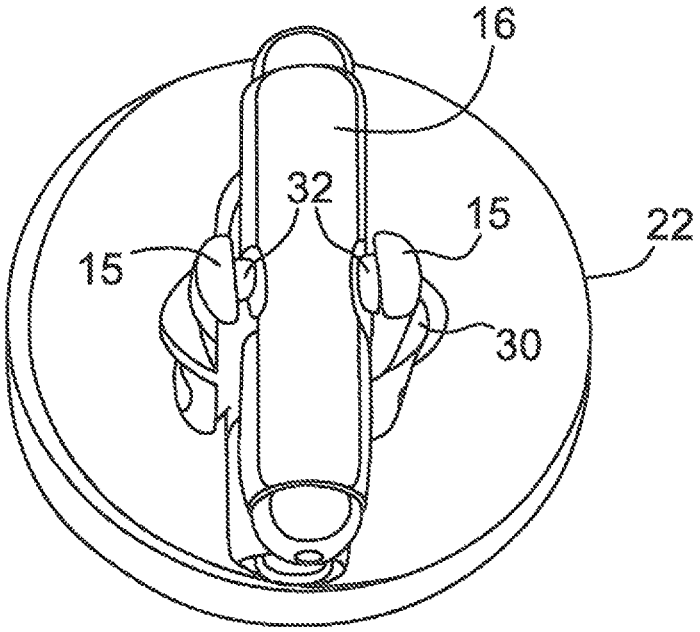
FIG. 5 is a perspective view of the assembled cufflink viewed from the back of the assembled cufflink.
Figure 6:
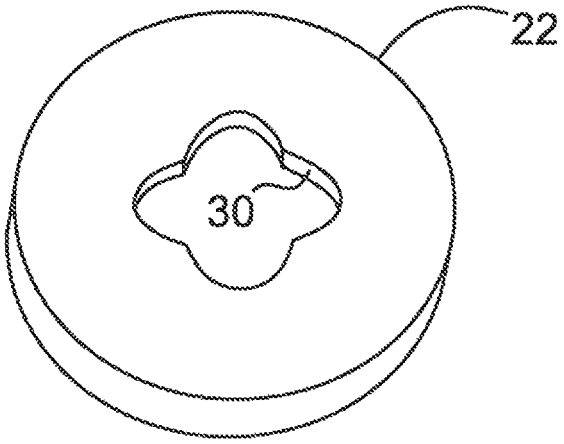
FIG. 6 is a view of an end cap forming part of the present cufflink.

FIGS. 1 to 6 show various views of a cufflink shown generally at 10 constructed in accordance with the present disclosure. Cufflink 10 includes a decorative head or face section 12, an elongate post 14 having its proximal end permanently attached to the back side of head section 12 and shaped in the form of a fork with two spaced tongs 15 forming the distal end of elongate post 14. An elongate toggle 16 pivotally mounted at its midpoint between the distal ends of the tongs 15 of elongate post 14, best seen in FIG. 2. Toggle member 16 is pivotally mounted to tongs 15 by a shaft 32 connected between tongs 15, see FIG. 5. A cufflink cap 22 includes an aperture 30 through which the toggle member 16 is inserted when the cufflink 10 is assembled, the back side of the assembled cufflink being shown in FIG. 5. FIGS. 1 and 2 show a section of a shirt sleeve 18 having an aperture 26 through which the toggle member 16 and post 14 are inserted when the cufflink is being attached to the cuff of the shirt. FIG. 6 shows the cap 22 by itself.

Cufflink 10 includes a rubber based, compressible spacer member 20, made of a rubbery material to provide friction, and an aperture 28 is located in the central area of insert 20 which aligns with aperture 30 in cap 22 through which the toggle member 16 and the distal ends of tongs 15 are inserted when the cufflink 10 is attached to a cuff of a shirt. A useful material that member 20 may be made from is silicone. The compressible spacer member 20 has a size including thickness (T) and shape so that when assembled in the shirt cuff, if the toggle member 16 is inadvertently rotated to the position in which it is colinear with tongs 15, the ends of toggle 16 abut up against the back surface of cap 22 and the user needs to apply some force to deform the compressible spacer member 20 and move it and cap 22 towards the head 12 to bring the toggle member 16 into colinear alignment with elongate post member 14 parallel to tongs 15. Essentially the spacer 22 thickness T is selected to keep cap 22 secured tight against the back surface of decorative head 12 to prevent free swiveling of toggle 16 so that cap 22 and spacer 20 are sandwiched between the toggle 16 (when perpendicular to tongs 15) and the back surface of head 12. Thus, when cuff 10 is being removed from the cuff of the shirt, the person wearing the shirt must apply force to the end of toggle member 16 to squeeze or deform insert 20 in order to displace cap 22 toward head 12 to force toggle member 16 into a colinear alignment with tongs 15. In this way, the chances of toggle member 16 accidently moving to the colinear position are considerably reduced.

Thus, the thickness (T) of insert 20 (FIG. 2) along with the thickness of the cap 22 is selected so that when the cufflink is assembled on the shirt sleeve 18 the elongate toggle member 16, when rotated to the closed position where it is perpendicular to elongate shaft 14, there is very little room between toggle 16 and the outer surface of cap 22 so that toggle 16, when rotated to the open position where it is colinear with post 14, the end of the toggle pushes against the outer surface of cap 22 producing friction. The toggle 16 must then be forced into the open position which results in the compressible spacer 20 being squeezed which forces cap 22 towards the head 12 of the cufflink 10 thereby preventing accidental or unintentional opening and dislodgement of the cufflink 10 from the shirt. Put another way, when the insert 20 and cap 22 have a large enough combined thickness, this acts to force the toggle member 16 into being perpendicular to tongs 15 thereby preventing it from inadvertently opening. This requires the user to apply force to toggle 16 to bring it parallel to tongs 15 when it is being removed from the cufflink.

Therefore what is claimed is:

1. A cufflink, comprising:

a) a decorative head member having an outward facing decorative surface and a back surface;

b) an elongate post member having a proximal end permanently affixed to said back surface of said decorative head member, an elongate toggle member pivotally attached to a distal end of said elongate post member and moveable between an open position wherein said elongate toggle member is colinear with said elongate post member, for insertion through one side of a cuff of a shirt, and a closed position wherein said elongate toggle member is rotated perpendicular to said elongate post member, on an opposite side of the cuff of the shirt with said elongate post member and a portion of said elongate post member inserted through the cuffs of the shirt;

c) a rigid cap member having an aperture centrally disposed in said cap member for receiving therethrough said toggle member and said distal end of said elongate post member; and d) a compressible spacer member having a generally centrally located aperture for receiving therethrough said toggle member and said distal end of said elongate post member on the opposite side of the cuff of the shirt, said compressible spacer member being made of a rubber based material, said compressible spacer member having a size and shape to be received into said cap member, said rigid cap member and said compressible spacer member having a combined thickness such that when assembled on the shirt sleeve with said elongate toggle member in the closed position it abuts an outer face of said rigid cap member to reduce inadvertent pivoting of the elongate toggle member into colinear alignment with said elongate post member.

2. The cuff link according to claim 1, wherein said distal end of said elongate post member includes two tong sections spaced apart, and wherein said elongate toggle member is pivotally attached to said two tong sections between said two tong sections.

3. The cuff link according to claim 2, wherein said compressible spacer is made of silicone rubber.

4. The cuff link according to claim 1, wherein said compressible spacer is made of silicone rubber.

* * * * *